US005662328A

United States Patent [19]

Pecoy

[11] Patent Number: 5,662,328

[45] Date of Patent: Sep. 2, 1997

[54] HALLOWEEN BOARD GAME

[76] Inventor: Cyrilla Dianne Pecoy, R.D. #1, Box 210 E, Oswego, N.Y. 13126

[21] Appl. No.: 524,991

[22] Filed: Sep. 8, 1995

[51] Int. Cl.[6] ..... A63F 3/00

[52] U.S. Cl. ..... 273/248

[58] Field of Search ..... 273/242, 243, 273/248, 251, 252, 254

[56] References Cited

U.S. PATENT DOCUMENTS

| | | | |
|---|---|---|---|
| 3,567,226 | 3/1971 | Matthews | 273/248 |
| 4,003,577 | 1/1977 | Bolach | 273/243 |
| 4,120,503 | 10/1978 | Macrory et al. | 273/248 X |
| 4,368,889 | 1/1983 | Reker, Jr. | 273/248 X |
| 4,585,232 | 4/1986 | Sheppard et al. | 273/248 |
| 4,934,708 | 6/1990 | Kolkind | 273/248 X |
| 5,121,928 | 6/1992 | Salerno-Sonneberg . | |
| 5,139,268 | 8/1992 | Garnett . | |
| 5,183,257 | 2/1993 | Shore . | |
| 5,251,905 | 10/1993 | Bombino . | |
| 5,282,630 | 2/1994 | Dupuis, Jr. . | |

*Primary Examiner*—William E. Stoll

[57] ABSTRACT

A board game includes a game board which includes a predetermined number of start/stop positions, a predetermined number of trick or treat positions, and a single endless path which includes a start/stop path portion adjacent to the start/stop positions and a trick-or-treat path portion adjacent to the trick or treat positions. The endless path defines an interior board region which includes a first capture region, a second capture region, a first safe region, and a second safe region. The endless path includes a sequential array of segments which include capture-free segments interspersed with capture-susceptible segments. A predetermined number of groups of Halloween treat cards are provided which corresponds to the predetermined number of trick or treat positions. A predetermined number of treat-receiving player tokens is provided. A first player-capturing token is associated with the first capture region, and a second player-capturing token is associated with the second capture region. During their respective turns, the first and second capture tokens are enabled to capture a specific treat-receiving player token when the specific treat-receiving player token lands on a capture-susceptible segment of the endless path. A pair of dice is used for determining a number of segments along the endless path that a specific treat-receiving player token advances during its turn.

8 Claims, 3 Drawing Sheets

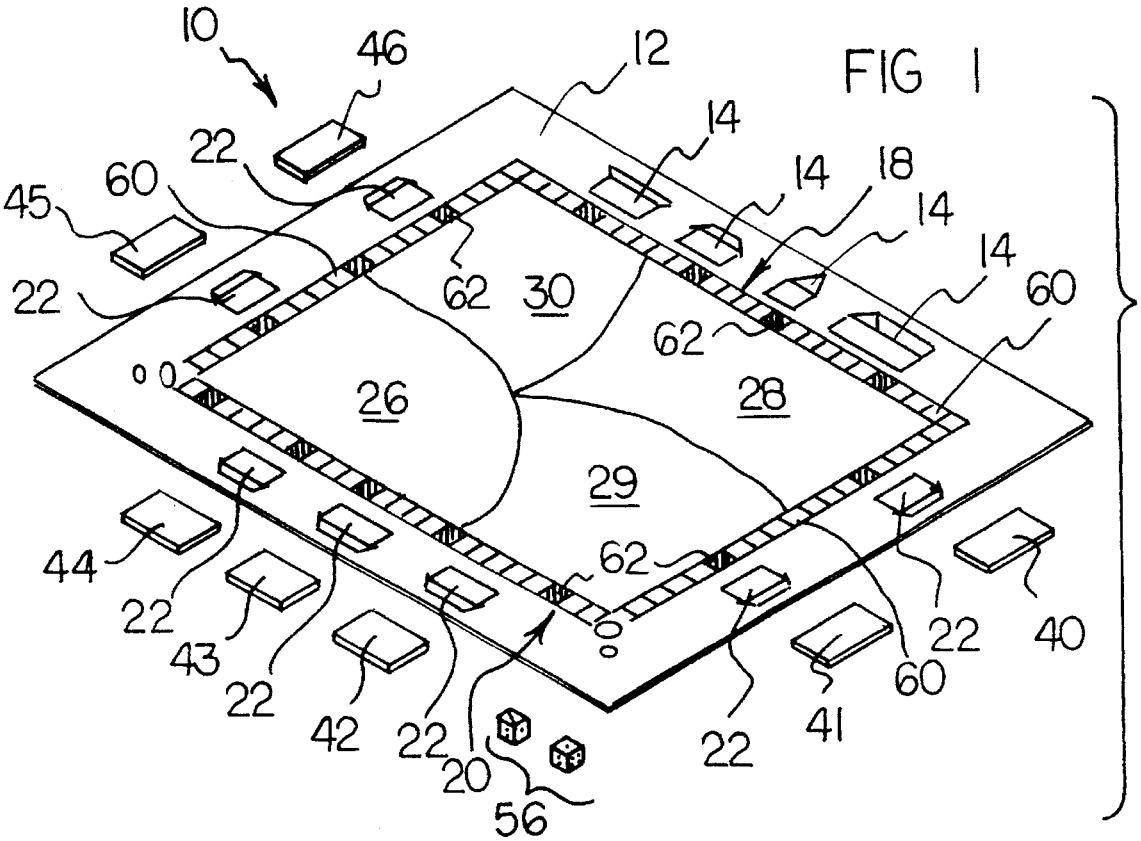
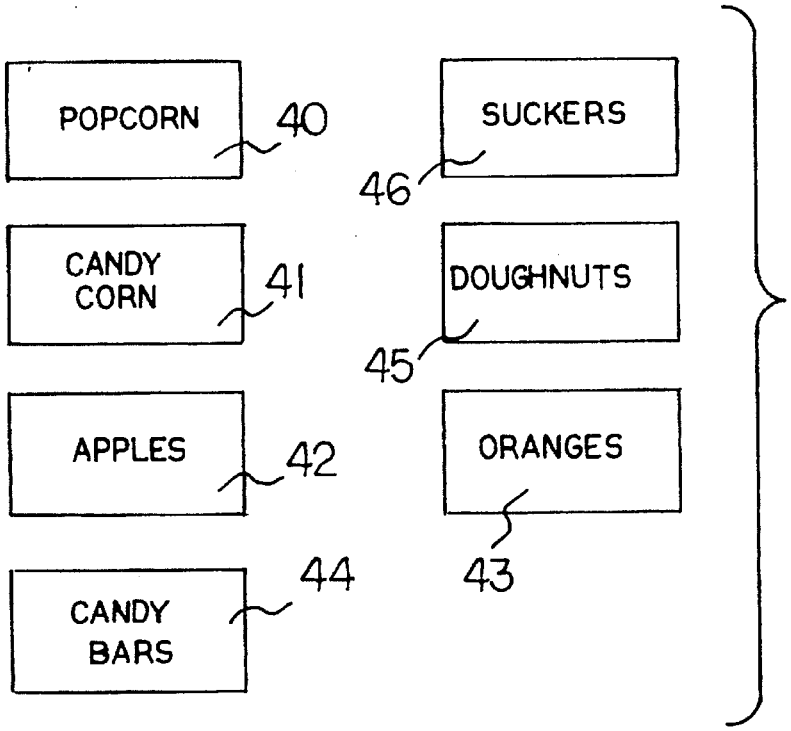
FIG 2

FIG 4
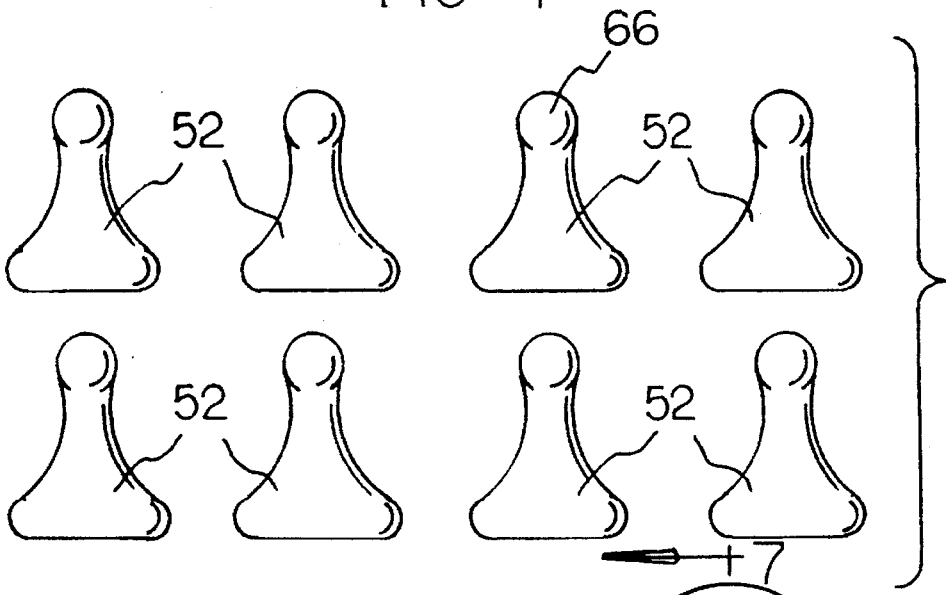
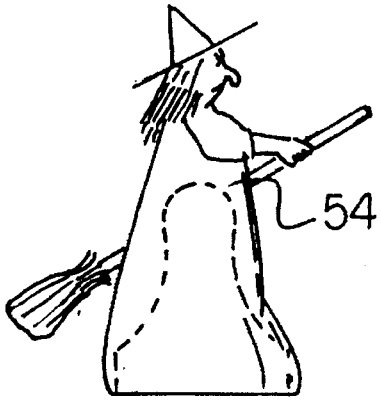
FIG 6
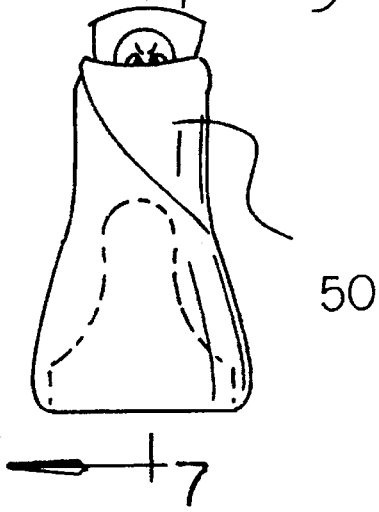
FIG 5
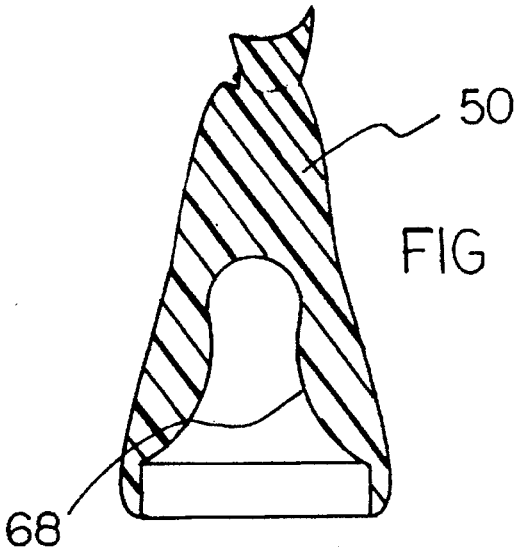
FIG 7

HALLOWEEN BOARD GAME

BACKGROUND OF THE INVENTION

1. Field of the Invention

The present invention relates generally to board games and, more particularly, to a board game especially related to activities associated with the holiday of Halloween.

2. Description of the Prior Art

The playing of board games is a popular pastime among many people. Moreover, throughout the years, a number of innovations have been developed relating to board games, and the following U.S. patents are representative of some of those innovations: U.S. Pat. Nos. 5,121,928; 5,139,268; 5,183,257; 5,251,905; and 5,282,630. More specifically, U.S. Pat. No. 5,121,928 discloses a board game that is based on information recall. Although such information recall games may be enjoyable to adults who have accumulated a large fund of knowledge over the years, such an information recall board game may not be playable by a young child. In this respect, it would be desirable if a board game were provided which does not require information recall to play the game.

U.S. Pat. No. 5,139,268 discloses a board game in which all players start at the same location and finish at the same location. To add extra interest to board game, it would be desirable if each player could start at a different location and finish at a different location.

Moreover, each of U.S. Pat. Nos. 5,139,268 and 5,183,257 discloses a board game which has two paths. A long path has less risks, and a short path has more risks. For some players, especially very young players, the need to make a choice of taking risks or not taking risks may be an undesirable undertaking. For some players, such risk taking may take the fun out of the game. In this respect, it would be desirable if a board game were provided which does not require a player to make choices among less risky long paths or more risky short paths to take.

U.S. Pat. No. 5,251,905 discloses a war game in which each player tries to capture the other players pieces. Rather than have a board game depend solely upon capturing the opponents pieces, it would be desirable if a board game had a mode of playing which provides for more than capturing an opponents pieces.

U.S. Pat. No. 5,282,630 is another board game that has one start point and one finish point for all players. As discussed above with respect to U.S. Pat. No. 5,139,268, it would be desirable if each player could start at a different location and finish at a different location.

Clearly, none of the patents discussed above discloses a board game which relates to the holiday of Halloween. Because the holiday of Halloween is of great interest to many people, especially children who enjoy going on trick or treat, it would be desirable if a board game were provided which relates to the holiday of Halloween.

In the board games discussed above, all the players compete with one another to reach a common goal. To add variety and interest in a board game, it would be desirable if different players in the same game had different goals. In such a board game, the winner of the game would be the person who reaches one's respective goal before any other player reaches one's respective goal.

Thus, while the foregoing body of prior art indicates it to be well known to use board games, the prior art described above does not teach or suggest a Halloween board game which has the following combination of desirable features:

(1) does not require information recall to play the game; (2) permits each player to start at a different location and finish at a different location; (3) does not require a player to make choices of taking less risky long paths or more risky short paths; (4) provides for more than capturing the pieces of an opponent; (5) relates to the holiday of Halloween; and (6) permits different players in the same game to have different goals from each other to win the game. The foregoing desired characteristics are provided by the unique Halloween board game of the present invention as will be made apparent from the following description thereof. Other advantages of the present invention over the prior art also will be rendered evident.

SUMMARY OF THE INVENTION

To achieve the foregoing and other advantages, the present invention, briefly described, provides a board game which includes a game board which includes a predetermined number of start/stop positions, a predetermined number of trick or treat positions, and a single endless path which includes a start/stop path portion adjacent to the start/stop positions and a trick-or-treat path portion adjacent to the trick or treat positions. The endless path defines an interior board region which includes a first capture region, a second capture region, a first safe region, and a second safe region. The endless path includes a sequential array of segments which include capture-free segments interspersed with capture-susceptible segments. A predetermined number of groups of Halloween treat cards are provided, wherein each group of Halloween treat cards includes a predetermined number of respective Halloween treat cards. The predetermined number of groups of Halloween treat cards corresponds to the predetermined number of trick or treat positions. A predetermined number of treat-receiving player tokens is provided. A first player-capturing token is associated with the first capture region, and, during its turn, the first player-capturing token is enabled to capture a specific treat-receiving player token when the specific treat-receiving player token lands on a capture-susceptible segment of the endless path. A second player-capturing token is associated with the second capture region, and, during its turn, the second player-capturing token is enabled to capture a specific treat-receiving player token when the specific treat-receiving player token lands on a capture-susceptible segment of the endless path. A random number selection device, such as a pair of dice, is used for determining a number of segments along the endless path that a specific treat-receiving player token advances during its turn.

The game board is rectangular in shape. The start/stop positions are arrayed along one side of the game board. The trick or treat positions are arrayed along three sides of the game board. The endless path is rectangular in shape.

The first capture region represents a graveyard, and the first player-capturing token represents a vampire which effects capture of the treat-receiving player tokens for transport to the graveyard. The second capture region represents a haunted house, and the second player-capturing token represents a witch which effects capture of the treat-receiving player tokens to the haunted house. The first safe region represents a pumpkin patch which is a region on the game board in which the first player-capturing token and the second player-capturing token are not permitted to capture a treat-receiving player token. The second safe region represents a corn field which is another region on the game board in which the first player-capturing token and the second player-capturing token are not permitted to capture a treat-receiving player token.

There are seven groups of Halloween treat cards, and each group of Halloween treat cards includes eight Halloween treat cards. A first group of Halloween treat cards includes cards representing popcorn. A second group of Halloween treat cards includes cards representing candy corn. A third group of Halloween treat cards includes cards representing apples. A fourth group of Halloween treat cards includes cards representing oranges. A fifth group of Halloween treat cards includes cards representing candy bars. A sixth group of Halloween treat cards includes cards representing doughnuts. A seventh group of Halloween treat cards includes cards representing suckers.

The random number selection device is a pair of dice. Each of the treat-receiving player tokens includes a convex top portion. Each of the first player-capturing token and the second player-capturing token includes a concave bottom portion which is complementary to each of the convex top portions of the treat-receiving player tokens. Whereby, by fitting one of the concave bottom portions over one of the convex top portions, one of the first player-capturing token or the second player-capturing token can capture one of the treat-receiving player tokens.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved Halloween board game which has all of the advantages of the prior art and none of the disadvantages.

It is another object of the present invention to provide a new and improved Halloween board game which may be easily and efficiently manufactured and marketed.

It is a further object of the present invention to provide a new and improved Halloween board game which is of durable and reliable construction.

An even further object of the present invention is to provide a new and improved Halloween board game which is susceptible of a low cost of manufacture with regard to both materials and labor, and which accordingly is then susceptible of low prices of sale to the consuming public, thereby making such Halloween board game available to the buying public.

Still yet a further object of the present invention is to provide a new and improved Halloween board game which does not require information recall to play the game.

Still another object of the present invention is to provide a new and improved Halloween board game that permits each player to start at a different location and finish at a different location.

Yet another object of the present invention is to provide a new and improved Halloween board game which does not require a player to make choices of taking less risky long paths or more risky short paths.

Even another object of the present invention is to provide a new and improved Halloween board game that provides for more than capturing the pieces of an opponent.

Still a further object of the present invention is to provide a new and improved Halloween board game which relates to the holiday of Halloween.

Yet another object of the present invention is to provide a new and improved Halloween board game that permits different players in the same game to have different goals from each other to win the game.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a perspective view showing a preferred embodiment of the Halloween board game of the invention ready for playing.

FIG. 2 is a schematic view of an array of groups of Halloween treat cards of the invention.

FIG. 4 is a side view of an array of treat-receiving player tokens of the invention.

FIG. 5 is a side view of a first player-capturing token which is in the form of a vampire such as Dracula.

FIG. 6 is a side view of a second player-capturing token 54 which is the form of a witch.

FIG. 7 is an enlarged cross-sectional view of the first player-capturing token of FIG. 5 taken along line 7—7 thereof.

DESCRIPTION OF THE PREFERRED EMBODIMENT

Figure 3:
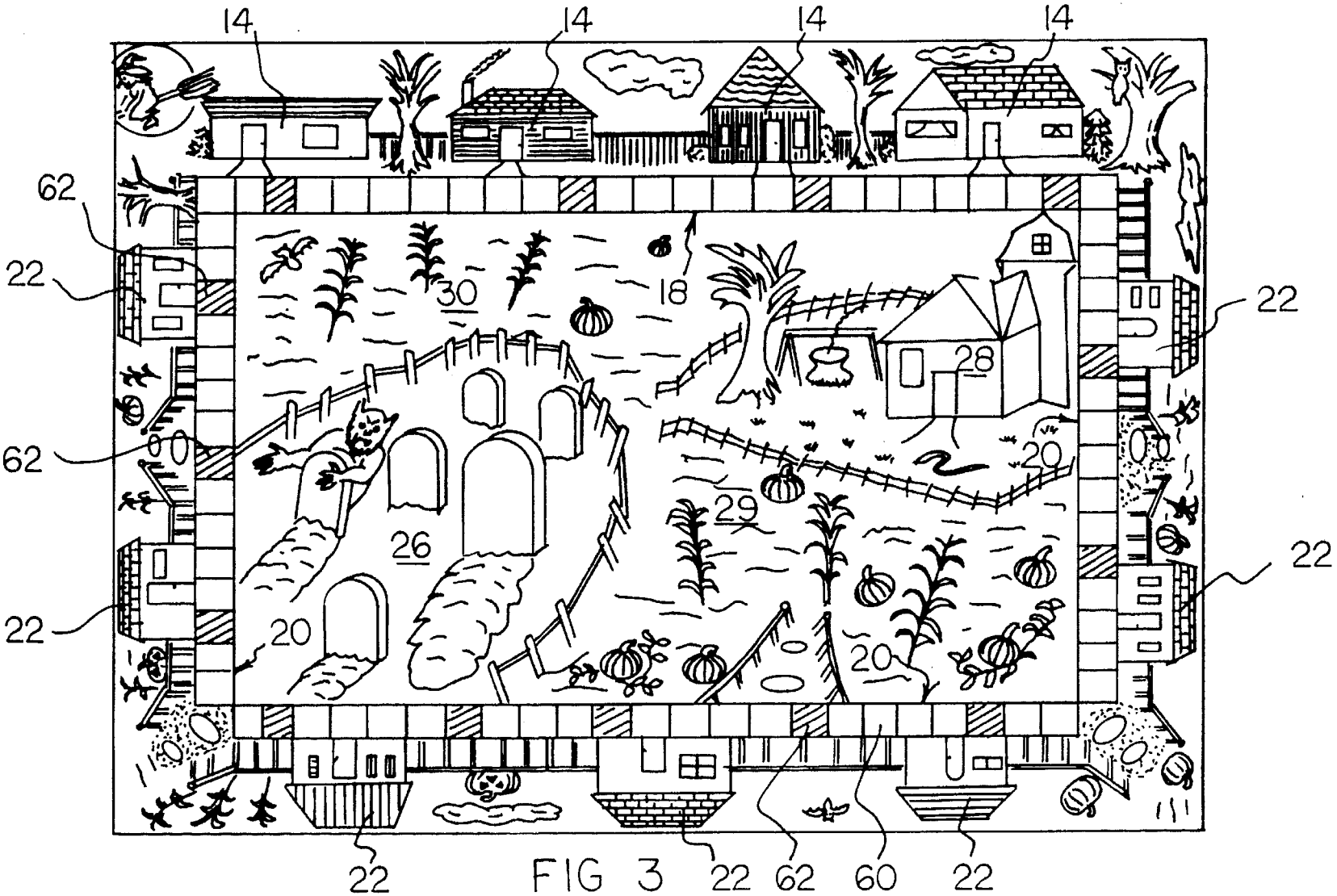
FIG. 3 is a detailed top view of the game board of the invention.

With reference to the drawings, a new and improved Halloween board game embodying the principles and concepts of the present invention will be described.

Turning to FIGS. 1–7, there is shown an exemplary embodiment of the Halloween board game of the invention generally designated by reference numeral 10. In its preferred fore, Halloween board game 10 includes a game board 12 which includes a predetermined number of start/stop positions 14, a predetermined number of trick or treat positions 22, and a single endless path which includes a start/stop path portion 18 adjacent to the start/stop positions 14 and a trick-or-treat path portion 20 adjacent to the trick or treat positions 22. The endless path defines an interior board region which includes a first capture region 26, a second capture region 28, a first safe region 29, and a second safe region 30. The endless path includes a sequential array of segments which include capture-free segments 60 interspersed with capture-susceptible segments 62. A predetermined number of groups of Halloween treat cards are provided, wherein each group of Halloween treat cards includes a predetermined number of respective Halloween treat cards. The predetermined number of groups of Halloween treat cards corresponds to the predetermined number of trick or treat positions 22. A predetermined number of treat-receiving player tokens 52 is provided. A first player-capturing token 50 is associated with the first capture region 26, and, during its turn, the first player-capturing token 50 is enabled to capture a specific treat-receiving player token 52 when the specific treat-receiving player token 52 lands on a capture-susceptible segment 62 of the endless path. A second player-capturing token 54 is associated with the second capture region 28, and, during its turn, the second player-capturing token 54 is enabled to capture a specific treat-receiving player token 52 when the specific treat-receiving player token 52 lands on a capture-susceptible segment 62 of the endless path. A random number selection device 56, such as a pair of dice 56, is used for determining a number of segments along the endless path that a specific treat-receiving player token 52 advances during its turn.

The game board 12 is rectangular in shape. The start/stop positions 14 are arrayed along one side of the game board 12. The trick or treat positions 22 are arrayed along three sides of the game board 12. The endless path is rectangular in shape.

The first capture region 26 represents a graveyard, and the first player-capturing token 50 represents a vampire which effects capture of the treat-receiving player tokens 52 for transport to the graveyard. The vampire can be a representation of Dracula. The second capture region 28 represents a haunted house, and the second player-capturing token 54 represents a witch which effects capture of the treat-receiving player tokens 52 to the house. The first safe region 29 represents a pumpkin patch which is a region on the game board 12 in which the first player-capturing token 50 and the second player-capturing token 54 are not permitted to capture a treat-receiving player token 52. The second safe region 30 represents a corn field which is another region on the game board 12 in which the first player-capturing token 50 and the second player-capturing token 54 are not permitted to capture a treat-receiving player token 52.

There are seven groups of Halloween treat cards, and each group of Halloween treat cards includes eight Halloween treat cards. A first group 40 of Halloween treat cards includes cards representing popcorn. A second group 41 of Halloween treat cards includes cards representing candy corn. A third group 42 of Halloween treat cards includes cards representing apples. A fourth group 43 of Halloween treat cards includes cards representing oranges. A fifth group 44 of Halloween treat cards includes cards representing candy bars. A sixth group 45 of Halloween treat cards includes cards representing doughnuts. A seventh group 46 of Halloween treat cards 46 includes cards representing suckers.

The random number selection device 56 is a pair of dice. Each of the treat-receiving player tokens 52 includes a convex top portion 66. Each of the first player-capturing token 50 and the second player-capturing token 54 includes a concave bottom portion 68 which is complementary to each of the convex top portions 66 of the treat-receiving player tokens 52. Whereby, by fitting one of the concave bottom portions 68 over one of the convex top portions 66, one of the first player-capturing token 50 or the second player-capturing token 54 can capture one of the treat-receiving player tokens 52.

In using the board game 10 of the invention, one object of the game is for each treat-receiving player to move one's respective treat-receiving player token 52 around the endless path stopping at each of the trick or treat positions 22 (each represented as a house) to pick up a treat present at each respective trick or treat house 22. The treat-receiving player that gets back to one's respective start/stop position 14 (each represented as a house) with a treat from each of the trick or treat houses 22 wins the game.

However, a first player-capturing player, who uses the first player-capturing token 50 (represented as a vampire, such as Dracula), and a second player-capturing player, who uses the second player-capturing token 54 (represented as a witch) has a second object in the game. The second object is to capture the treat-receiving player tokens 52 before they are able to return to the start/stop positions 14. Whichever of the vampire-like player-capturing token 50 or the witch-like player-capturing token 54 captures the most treat-receiving player tokens 52 before they arrive back at their respective start/stop houses 14 wins the game.

To start the game, the participants in the game must first decide which will use treat-receiving player tokens 52, which will use the vampire-like player-capturing token 50, and which will use the witch-like player-capturing token 54. Each respective treat-receiving player token 52 is placed in a respective start/stop house 14. With four start/stop houses 14. Each of four treat-receiving player tokens 52 is placed in one start/stop house 14. If more than four treat-receiving player tokens 52 are employed, more than one treat-receiving player token 52 can be placed in one start/stop house 14. The vampire-like player-capturing token 50 is placed in the first capture region 26 (which is represented as a graveyard), and the witch-like player-capturing token 54 is placed in the second capture region 28 (which is represented as a haunted house).

Each player takes a turn to operate the random number selection device 56, that is to throw the dice 56. A respective player moves one's respective token counterclockwise along the segments of the endless path in accordance with the number shown on the dice 56. After all the players using the treat-receiving player tokens 52 have had a turn and after all of the treat-receiving player tokens 52 are on the endless path, the player has the vampire-like player-capturing token 50 and the player has the witch-like player-capturing token 54 roll the dice 56 in turn. Each of the vampire-like player-capturing token 50 and the witch-like player-capturing token 54 must have a double number on the dice 56 in order to be able to come out of the graveyard capture region 26 and the haunted house capture region 28, respectively. Only one of the vampire-like player-capturing token 50 or the witch-like player-capturing token 54 need throw a double number on the dice 56 for both the vampire-like player-capturing token 50 and the witch-like player-capturing token 54 to come to the endless path. If neither of the vampire-like player-capturing token 50 or the witch-like player-capturing token 54 throws a double number on their first turn, they have to wait until their turn comes around again.

Once either of the vampire-like player-capturing token 50 or the witch-like player-capturing token 54 has a double number thrown for it on the dice 56, both of the capturing tokens must move immediately to an unoccupied capture-susceptible segment 62 on the endless path to try to capture a treat-receiving player token 52. In order to capture a treat-receiving player token 52, the vampire-like player-capturing token 50 and the witch-like player-capturing token 54 must have the exact number needed to capture a player in back or in front of the respective capturing token by landing on the same capture-susceptible segment 62 that a treat-receiving player tokens 52 is present on. It is noted that this is the only time that a capturing token rolls the dice 56 twice in a row, first to get on the endless path, and second to capture a treat-receiving player tokens 52.

If a treat-receiving player token 52 is on a capture-susceptible segment 62 somewhere else on the endless path and a capturing token rolls a double number, the treat-receiving player token 52 on the capture-susceptible segment 62 is captured. If two or more treat-receiving player tokens 52 are on the same capture-susceptible segment 62, then all are captured. In all other cases. A capturing token needs to have a roll of the dice 56 that provides an exact number of segments to capture a treat-receiving player token 52 nearest to the respective capturing token. If the capturing token does not roll the exact number needed or does not roll a double number to capture a treat-receiving player token 52 on a capture-susceptible segment 62, the capturing token must immediately move to another capture-susceptible segment 62 that is not occupied and wait for one's next turn at the dice.

Once each treat-receiving player token 52 is on the game board 12, each player for each treat-receiving player token 52 takes a successive turn at the dice 56 to advance one's respective treat-receiving player token 52 to each trick or treat house 22 for a treat. Each treat is represented by a Halloween treat card. A treat-receiving player token 52 cannot go past a trick or treat house 22 without picking up a treat card. In order to get into a trick or treat house 22 (on the door), the player for the respective treat-receiving player token 52 rolls the dice 56. Say, for example, that the player needs a 6 to get into the trick or treat house 22 but only rolls a 5. Then, the treat-receiving player token 52 must go to the door, but the treat-receiving player token 52 cannot pick up the Halloween treat card until one's next turn to roll the dice 56, pick up the Halloween treat card, and start back toward the next trick or treat house 22. If a player needs a 5 to get into a trick or treat house 22 and rolls more than one needs on the dice 56, the treat-receiving player token 52 can be moved into the trick or treat house 22, pick up a Halloween treat card, and continue moving out until one is back on the endless path, all in one move, moving only the number of segments corresponding to the number on the dice 56.

If a player has a treat-receiving player token 52 forgets a trick or treat house 22 along the way, the treat-receiving player token 52 must be moved back to the forgotten house by rolling the dice 56 and moving the number of segments on the endless path needed, at each min. Then, the treat-receiving player token 52 must come down the endless path and head for the next trick or treat house 22 that one needs to pick up a Halloween treat card from. This in one way a treat-receiving player token 52 can be moved backwards on the endless path, only to go back to a trick or treat house 22 that was forgotten. It is noted that as each Halloween treat card is picked up, the Halloween treat card is placed on the corresponding player's start/stop house 14. Each treat-receiving player token 52 must collect one Halloween treat card from each trick or treat house 22. That is, each treat-receiving player token 52 must collect one Halloween treat card from each of the groups 40, 41, 42, 43, 44, 45, and 46 of Halloween treat cards. More specifically, each treat-receiving player token 52 must collect one Halloween treat card from the group of popcorn cards, from the group of candy corn, from the group of apples, from the group of oranges, from the group of candy bars, from the group of doughnuts, and from the group of suckers.

It is recalled that there are capture-susceptible segments 62 interspersed with capture-free segments 60 on the endless path. The capture-susceptible segments 62 are the segments that the capturing tokens can fly to, anywhere on the endless path. If a treat-receiving player token 52 lands on a capture-susceptible segment 62 in front of a capturing token, then the player for the treat-receiving player token 52 must make a choice, if it is one's turn to move. The treat-receiving player token 52 can either go by the capturing token to try to make it to the next trick or treat house 22, or the treat-receiving player token 52 can hide in the first safe region 29 (the pumpkin patch 29) or the second safe region 30 (the corn field 30). If it is chosen to hide the treat-receiving player token 52 in the pumpkin patch 29 or in the corn field 30, the treat-receiving player token 52 must forfeit one's next turn, and immediately go to the hiding place, and wait the one's next turn.

If the player has the treat-receiving player token 52 chooses to move the treat-receiving player token 52 by the capturing token, the player must roll the dice 56 and hope that a sum will come up that will get the treat-receiving player token 52 past the capturing token. Once the player chooses to roll the dice 56, the player cannot hide, that is the player cannot go to the pumpkin patch 29 or the corn field 30. The player must make a move. If the treat-receiving player token 52 lands on the same capture-susceptible segment 62 as the vampire-like player-capturing token 50 or the witch-like player-capturing token 54, the treat-receiving player token 52 is captured.

When a turn comes around for a treat-receiving player token 52 which is hiding in either the pumpkin patch 29 or the corn field 30, the player for the treat-receiving player token 52 rolls the dice 56 and comes out on the endless path. Then the treat-receiving player token 52 is moved, backwards if necessary, during a turn to proceed to the next trick or treat house 22 to get the next Halloween treat card. Coming out of hiding is the only other time a player may move a treat-receiving player token 52 backwards in order to pick up a Halloween treat card from a trick or treat house 22 that was missed.

When a vampire-like player-capturing token 50 or a witch-like player-capturing token 54 has captured a treat-receiving player token 52, the captured treat-receiving player token 52 is brought to the graveyard 29 or the haunted house 30 depending upon which capturing token made the capture. Then, the vampire-like player-capturing token 50 or the witch-like player-capturing token 54 is placed on a capture-susceptible segment 62 and waits for one's next turn. During this time, the captured treat-receiving player token 52 may plan one's escape from capture.

To escape from capture, the treat-receiving player token 52, on one's mm at the dice 56, has to have rolled a double amber. If a double number is missed, the treat-receiving player token 52 cannot escape, and the player for the treat-receiving player token 52 must wait until the next roll of the dice 56. These steps are repeated until a double number is rolled on the dice 56. Once a double number is rolled, the treat-receiving player token 52 escapes and goes back to the last trick or treat house 22 that was missed, picks up the Halloween treat card, rolls the dice 56 again, and proceeds to the next trick or treat house 22. This is the only time that a player who has a treat-receiving player token 52 can roll the dice 56 twice in a row-first to escape and second to move onto the next trick or treat house 22.

Further with respect to places in which a treat-receiving player token 52 cannot be captured by a capturing token, the pumpkin patch 29 and the corn field 30 are capture-free places. Moreover. A treat-receiving player token 52 cannot be captured while in a trick or treat house 22. In addition, a treat-receiving player token 52 cannot be captured while on a path coming out of the pumpkin patch 29 or the corn field 30.

After a treat-receiving player token 52 has collected one of each type of the Halloween treat cards, and when the treat-receiving player token 52 approaches its start/stop house 14. An exact number for entry in the start/stop house 14 must be rolled on the dice 56 in order to enter the start/stop house 14. The treat-receiving player token 52 may be moved as many segments on the endless path as needed as long as it doesn't go over the amount needed. If only one segment is needed to enter the start/stop house 14, the only one die of the dice 56 is employed. This is the only time that only one die is employed. If a treat-receiving player token 52 is captured by a capturing token on the start/stop path portion 18 of the endless path, only a double number roll of the dice 56 is needed for the treat-receiving player token 52 to immediately go home to its start/stop house 14.

The game continues and ends when one of the treat-receiving player tokens 52 makes it to its start/stop house 14 with an accumulation of one Halloween treat card from each of the groups of Halloween treat cards. Alternatively, the game ends when all of the treat-receiving player tokens 52 are captured, some by both the vampire-like player-capturing token 50 and the witch-like player-capturing token 54. Then, the one of the vampire-like player-capturing token 50 and the witch-like player-capturing token 54 that has captured most of the treat-receiving player tokens 52 wins the game.

As described above, six to ten people can play the board game 10. With one vampire-like player-capturing token 50, one witch-like player-capturing token 54, and four treat-receiving player tokens 52, there are six players. With one vampire-like player-capturing token 50, one witch-like player-capturing token 54, and eight treat-receiving player tokens 52, there are ten players. Generally, the vampire-like player-capturing token 50 and the witch-like player-capturing token 54 roll the dice 56 last. However, there is one exception, if there are six or eight treat-receiving player tokens 52, then the players for the witch-like player-capturing token 54 and the vampire-like player-capturing token 50 roll the dice 56 after the dice is rolled for the first four treat-receiving player tokens 52, and again after the dice rolls for the next four treat-receiving player tokens 52.

Depending on the number of players using treat-receiving player tokens 52, the same number of Halloween treat cards are employed in each group of Halloween treat cards associated with each of the trick or treat houses 22. For example, when four treat-receiving player tokens 52 are employed, there are four Halloween treat cards employed in each of the groups of Halloween treat cards.

The components of the Halloween board game of the invention can be made from inexpensive and durable cardboard and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved Halloween board game that is low in cost, relatively simple in design and operation, and which may be advantageously used without requiring information recall to play the game. With the invention, a Halloween board game is provided which permits each player to start at a different location and finish at a different location. With the invention, a Halloween board game is provided which does not require a player to make choices of taking less risky long paths or more risky short paths. With the invention, a Halloween board game provides for more than capturing the pieces of an opponent. With the invention, a Halloween board game is provided which relates to the holiday of Halloween. With the invention, a Halloween board game is provided which permits different players in the same game to have different goals from each other to win the game.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

What is claimed as being new and desired to be protected by Letters Patent of the United States is as follows:

1. A board game, comprising:

a game board which includes a predetermined number of start/stop positions, a predetermined number of trick or treat positions, a single endless path which includes a start/stop path portion adjacent to said start/stop positions and a trick-or-treat path portion adjacent to said trick or treat positions, wherein said endless path defines an interior board region which includes a first capture region, a second capture region, a first safe region, and a second safe region, wherein said endless path includes a sequential array of segments which include capture-free segments interspersed with capture-susceptible segments, a predetermined number of groups of Halloween treat cards, wherein each group of Halloween treat cards includes a predetermined number of Halloween treat cards, wherein the predetermined number of groups of Halloween treat cards corresponds to the predetermined number of trick or treat positions, a predetermined number of treat-receiving player tokens, a first player-capturing token associated with said first capture region, wherein, during its turn, said first player-capturing token is enabled to capture a specific treat-receiving player token when said specific treat-receiving player token lands on a capture-susceptible segment of said endless path, a second player-capturing token associated with said second capture region, wherein, during its turn, said second player-capturing token is enabled to capture a specific treat-receiving player token when said specific treat-receiving player token lands on a capture-susceptible segment of said endless path, and a random number selection device for determining a number of segments along said endless path that a specific treat-receiving player token advances during its turn.

2. The board game of claim 1 wherein:

said game board is rectangular in shape, said start/stop positions are arrayed along one side of said game board, said trick or treat positions are arrayed along three sides of said game board, and said endless path is rectangular in shape.

3. The board game of claim 1 wherein:

said first capture region represents a graveyard, said first player-capturing token represents a vampire which effects capture of said treat-receiving player tokens for transport to the graveyard, said second capture region represents a house, said second player-capturing token represents a witch which effects capture of said treat-receiving player tokens to the house, said first safe region represents a pumpkin patch which is a region on said game board in which said first player-capturing token and said second player-capturing token are not permitted to capture a treat-receiving player token, and said second safe region represents a corn field which is a region on said game board in which said first player-capturing token and said second player-capturing token are not permitted to capture a treat-receiving player token.

4. The board game of claim 1 wherein:

there are seven groups of Halloween treat cards, and each group of Halloween treat cards includes eight Halloween treat cards.

5. The board game of claim 1 wherein:

a first group of Halloween treat cards includes cards representing popcorn, a second group of Halloween treat cards includes cards representing candy corn, a third group of Halloween treat cards includes cards representing apples, a fourth group of Halloween treat cards includes cards representing oranges, a fifth group of Halloween treat cards includes cards representing candy bars, a sixth group of Halloween treat cards includes cards representing doughnuts, and a seventh group of Halloween treat cards includes cards representing suckers.

6. The board game of claim 1 wherein said random number selection device is a pair of dice.

7. The board game of claim 1 wherein each of said treat-receiving player tokens includes a convex top portion.

8. The board game of claim 7 wherein each of said first player-capturing token and said second player-capturing token includes a concave bottom portion which is complementary to each of said convex top portions of said treat-receiving player tokens, whereby, by fitting one of said concave bottom portions over one of said convex top portions, one of said first player-capturing token or said second player-capturing token can capture one of said treat-receiving player tokens.

* * * * *